United States Patent [19]

Post

[11] 4,334,208

[45] Jun. 8, 1982

[54] COIL FORMER FOR A TRANSFORMER

[75] Inventor: Sieghard Post, Guntersdorf, Fed. Rep. of Germany

[73] Assignee: U.S. Philips Corporation, New York, N.Y.

[21] Appl. No.: 193,210

[22] Filed: Oct. 2, 1980

[30] Foreign Application Priority Data

Oct. 16, 1979 [DE] Fed. Rep. of Germany ..... 2941756

[51] Int. Cl.[3] ..... H01F 15/10

[52] U.S. Cl. ..... 336/192

[58] Field of Search ..... 336/192, 198, 208; 310/71, 234, 260, 270

[56] References Cited

U.S. PATENT DOCUMENTS

| | | | |
|---|---|---|---|
| 744,650 | 11/1903 | Varley | 336/192 |
| 2,667,624 | 1/1954 | Bels | 336/192 X |
| 3,208,036 | 9/1965 | Harrison | 336/192 X |
| 3,395,452 | 8/1968 | Hummel | 336/192 X |

FOREIGN PATENT DOCUMENTS

| | | | |
|---|---|---|---|
| 1227149 | 10/1966 | Fed. Rep. of Germany | 336/192 |

*Primary Examiner*—Thomas J. Kozma

*Attorney, Agent, or Firm*—Thomas A. Briody; Robert T. Mayer; Bernard Franzblau

[57] ABSTRACT

A coil former for a transformer, comprising at least one connection strip at the area at which ends of connection wires and coil wires are interconnected via connection pins. Each connection pin is formed from a twisted loop of the relevant connection wire.

8 Claims, 4 Drawing Figures

COIL FORMER FOR A TRANSFORMER

The invention relates to a coil former for a transformer comprising at least one connection strip at the area where connection wire ends and coil wire ends are interconnected by means of connection pins.

In known, commercially available transformer coils the connection pins are moulded in the connection strips. The coil wire ends are wrapped around these connection pins, preferably by means of automatic coil winding devices. The connection wires of the apparatus are connected to the connection pins at a later stage. It is often desirable that the transformer coils be presented directly with connected connection wires. In that case the connection wires must be secured to the connection strip and be connected to the connection pins, for example, by soldering.

From U.S. Pat. No. 2,929,132 it is known to provide the connection pins for transformer coils with a loop around which a connection wire end can be wound. A coil wire end is then wrapped around such a loop. Due to the necessary threading, this is a very time consuming operation which cannot be automatically performed.

An object of the invention is to provide a coil former for a transformer where the embedding of connection pins can be dispensed with while suitable fixing is still possible.

To this end, a coil former in accordance with the invention is characterized in that each connection pin is formed from twisted loop of the relevant connection wire.

Thus, in a coil former of this kind the connection wire end is used to form a connection pin which has all the properties of an embedded connection pin but which need not be provided as a separate component. It is merely necessary to provide an automatic winding machine with a device for pulling out and twisting the loop.

In a further embodiment in accordance with the invention, duct-shaped inlet paths for the connection wires are provided in the connection strip and at the area of the connection pins to be formed there are provided recesses in which the rectilinearly inserted connection wire can be picked up and pulled out to form a twistable loop. The connection pins can thus be simply formed in that a grip grips the wire in the recess and pulls out the connection wire to form a loop. After the wire is pulled out, the loop is twisted from the top by way of the grip, thus forming the connection pin.

In a further embodiment in accordance with the invention, a tooth-shaped projection projects into the duct-shaped inlet path, said projection having a flat run-on face in the wire insertion direction and a steep hold-back face in the opposite direction. This tooth-shaped projection thus forms a simple strain relief.

Figure 1:
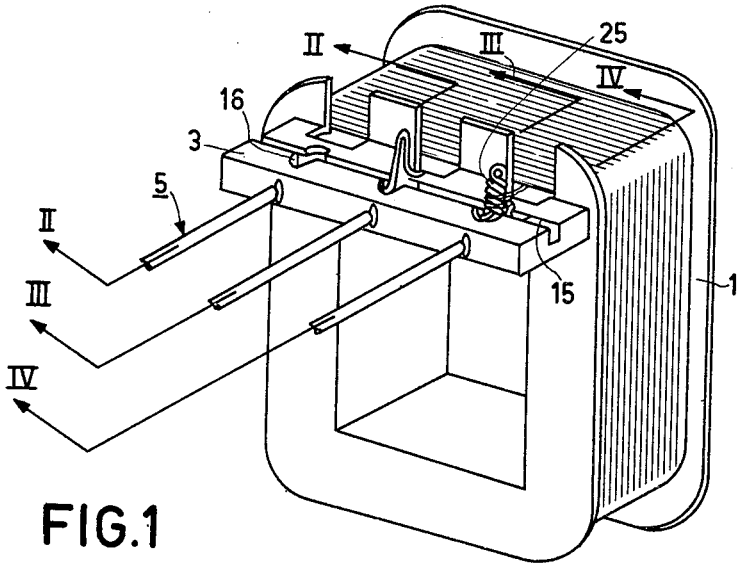
Figure 2:
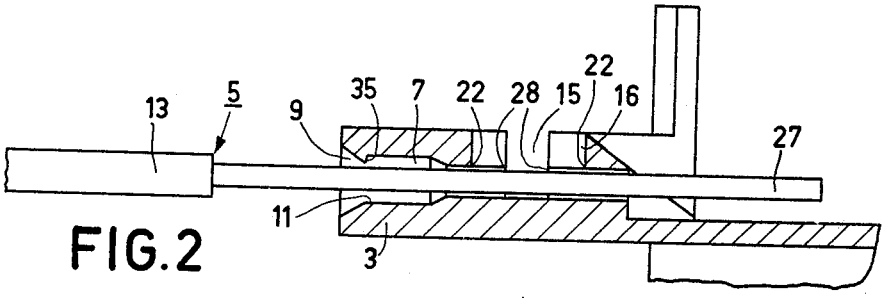
Figure 3:
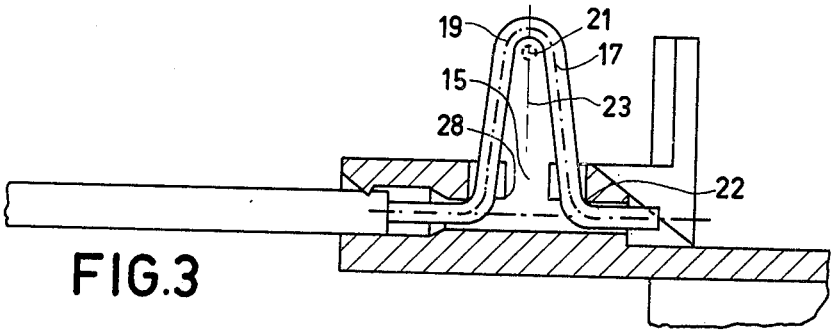
Figure 4:
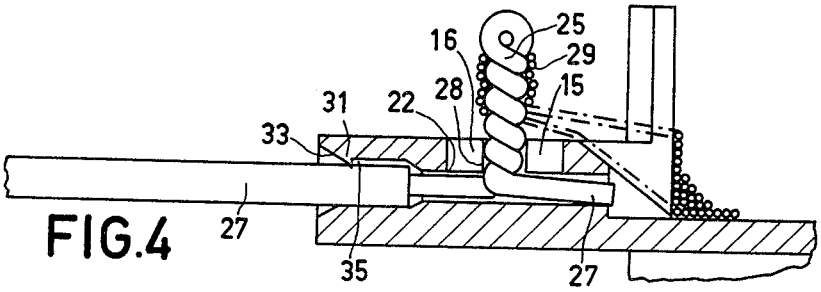

An embodiment in accordance with the invention will be described in detail hereinafter, by way of example, with reference to the accompanying diagrammatic drawing, in which:

FIG. 1 is a perspective view of a coil former in accordance with the invention comprising connection pins in different stages of manufacture, FIG. 2 is a sectional view, taken along the line II—II, of a detail of the coil former shown in FIG. 1, showing the inlet duct in which a connection wire end is inserted, FIG. 3 is a sectional view, taken along the line III—III, of a corresponding detail, a loop being formed from the connection wire end by pulling out a central portion of the wire, and FIG. 4 is a sectional view, taken along the line IV—IV, of a corresponding detail, comprising a connection pin, formed by the twisting of the pulled out loop, and coil winding wire ends connected thereto.

The coil former 1 shown in FIG. 1 comprises a connection strip 3 which serves to establish the connection between the coil wire ends and the connection wire ends. On the connection strip connection pins have to be formed from the connection wire ends themselves.

For each connection wire there is formed a duct-like inlet path 7 in the connection strip 3 (see FIG. 2). The part 11 thereof which is situated near the inlet aperture 9 has a larger diameter for accommodating the insulating jacket 13 which surrounds the connection wire 5. In FIG. 2, the connection wire is slid through the inlet duct 7 and beyond a pick-up recess 15. Transversely of the pick-up recess an aperture 16 extends in the upper part of the connection strip above the inlet duct 7.

A grip 21 (FIG. 3) which is only diagrammatically shown can grip the wire in the pick-up recess 15 in order to pull a loop 17 out of the inlet duct 7. The free, non-insulated end 27 of the connection wire 5 and the part provided with the insulating jacket 13 are then pulled in the direction of the pick-up recess 15 and the loop 17. The loop 17 is formed between the corners 22 of the recess 16.

The loop 17 has a gripping arc 19 which is arranged around the grip 21 and which is denoted by broken lines. When this grip is rotated around an axis 23, the loop 17 is twisted, thus forming the connection pin 25 shown in FIG. 4. The non-insulated connection wire end and the part of the connection wire insulated by means of the jacket 13 are then pulled very far towards the pick-up recess 15. A fixed position of the connection pin 25 is obtained by clamping the connection wire onto deliberately sharp corners 28 of the transition between the recess 16 and the pick-up recess 15. Around the connection pin 25 there are wrapped one or more coil wire ends 29 which are soldered or welded to the connection pin 25 obtained by the twisting of the loop 17.

A tooth-shaped projection 31 projects into the part 11 of the inlet duct 7, said projection comprising

What is claimed is:

1. A coil former comprising a support member adapted to support a coil wire having coil wire ends, said support member including at least one connection strip member, connection pins being formed from twisted loops of connection wires, the connection strip member including duct-like inlet paths therein through which the connection wires pass and a pick-up recess which communicates with the inlet paths so that a connection wire in each inlet path can be picked up and pulled out of the pick-up recess and twisted to form said twisted loop connection pins, the twisted loop extending through the pick-up recess substantially at right angles to non-twisted portions of the connection wire positioned in the inlet path on each side of the recess, said connection strip member located at an area where the ends of connection wires and the coil wire ends are adapted to be interconnected by means of said connection pins.

2. A coil former as claimed in claim 1 wherein each duct-like inlet path includes a tooth-shaped projection that projects into the inlet path with each said projection comprising a flat run-on face in the direction of wire insertion and a steep hold-back face in the opposite direction.

3. A coil former comprising a support member for a coil wire and having a connection strip member with a channel therein for an external connection wire, a connection wire within said channel, a recess in one surface of the connection strip member which recess communicates with said channel to expose the connection wire in the channel, said channel having portions extending laterally from opposite sides of the recess so that connection wire portions extend into each channel portion and said connection wire extending part way out of the channel via the recess to form a loop that is twisted to form a twisted loop connection pin integral with the connection wire and adapted to provide a connection point for an end of the coil wire.

4. A coil former as claimed in claim 3 wherein said recess extends at a right angle to the axis of the channel.

5. A coil former as claimed in claims 3 or 4 wherein the twisted loop connection pin extends through the recess substantially at a right angle to the non-twisted portions of the connection wire located within the channel.

6. A coil former as claimed in claims 3 or 4 wherein a part of said channel is shaped to form a tooth-shaped projection therein arranged to fix the connection wire in place within the connection strip member.

7. A coil former as claimed in claims 3 or 4 wherein the support member has a generally rectangular shape with a pair of flanges thereon and said connection strip member has a generally rectangular shape and is located on an external flat surface of one of said flanges.

8. A coil former as claimed in claim 7 wherein said channel is substantially rectilinear and passes through one surface of the connection strip member at a right angle thereto and the recess comprises a linear duct in a second surface of the connection strip member that extends at a right angle to said one surface and with the linear duct extending at a right angle to the channel.

* * * * *